US005557845A

United States Patent [19]

Burkett et al.

[11] Patent Number: 5,557,845

[45] Date of Patent: Sep. 24, 1996

[54] METHOD FOR INSTALLING A STATIONARY SCROLL

[75] Inventors: Michael J. Burkett, Lockport; Nikolaos A. Adonakis, Grand Island, both of N.Y.

[73] Assignee: General Motors Corporation, Detroit, Mich.

[21] Appl. No.: 407,127

[22] Filed: Mar. 20, 1995

[51] Int. Cl.[6] ..... B23P 15/00

[52] U.S. Cl. ..... 29/888.022; 418/55.1; 418/55.5; 418/55.6

[58] Field of Search ..... 29/888.022; 418/55.1, 418/55.5, 55.6

[56] References Cited

U.S. PATENT DOCUMENTS

| | | | |
|---|---|---|---|
| 4,597,724 | 7/1986 | Sato et al. | 418/55 |
| 4,645,437 | 2/1987 | Sakashita et al. . | |
| 4,761,122 | 8/1988 | Matsugi et al. | 418/55.1 |
| 4,795,324 | 1/1989 | Matsugi et al. | 418/55.1 |
| 5,308,231 | 5/1994 | Bookbinder et al. | 418/55.6 |
| 5,346,376 | 9/1994 | Bookbinder et al. . | |

FOREIGN PATENT DOCUMENTS

| | | | |
|---|---|---|---|
| 350790 | 1/1990 | European Pat. Off. | 418/55.1 |
| 4-143475 | 5/1992 | Japan | 418/55.1 |
| 4-262084 | 9/1992 | Japan | 418/55.1 |

*Primary Examiner*—Carl J. Arbes
*Attorney, Agent, or Firm*—Patrick M. Griffin

[57] ABSTRACT

A scroll compressor locks the stationary scroll into the compressor housing without the use of any separate fasteners that pierce the housing. Cooperating locking ramps on the housing and scroll end plate wedge together when the two are relatively turned to pull the lower surface of the end plate tight against an annular shelf in the housing. A seal is also compressed, a seal that serves as a spring to maintain the ramps latched together. Staggered cylindrical baffle walls on the underside of the end plate and inside of the rear head give an exhaust chamber that is muffled as well as sealed.

3 Claims, 2 Drawing Sheets

METHOD FOR INSTALLING A STATIONARY SCROLL

This invention relates to scroll compressors in general, and specifically to an improved method of installing the stationary scroll into a compressor housing.

BACKGROUND OF THE INVENTION

Scroll compressors operate by the rotation of one involute scroll relative to another, stationary scroll. Fluid pockets created between line contacting flanks of the scrolls are continually squeezed radially inwardly toward the central axis of the compressor housing. The compressed, pressurized refrigerant is forced through an outlet cut through the center of the end plate of the stationary scroll and into a sealed exhaust chamber formed between the underside of the scroll end plate and a rear head of the compressor housing. Within the exhaust chamber, the pressurized refrigerant is subject to pressure waves and pulsations that may cause undesirable noise levels, if not muffled. From the exhaust chamber, the pressurized refrigerant exits to a high pressure refrigerant line through a simple outlet, and eventually runs through a condenser.

Because the scroll itself requires a good deal of careful machining, it must be installed inside the housing separately. Most often, the scroll end plate is simply fixed into the housing by threaded bolts that run through the rear head and into the stationary scroll end plate. An example can be seen in U.S. Pat. No. 4,597,724. This is a simple securement technique, but leaves several potential leak paths out of the high pressure exhaust chamber at the points where the bolts pierce the rear head. Another design, shown in co-assigned U.S. Pat. No. 5,346,376, has a rear head that is molded integral to the cylindrical housing wall, and which is pierced only by the high pressure line outlet. The stationary scroll sits inside the housing wall on a cylindrical flange that holds it axially above the rear head. The stationary scroll is fixed to the flange by pins that prevent it from twisting, but which allow it to float axially, thereby adjusting the axial thrust pressure on seals that run along the tip of the scroll's involute wraps. This scroll securement technique is really only suitable for this specific compressor design, and not for a more conventional stationary scroll that is not designed to float axially.

Another means of securing the stationary scroll is to cast it integrally to and with the rear head. The rear head-stationary scroll unit is then fixed to the rest of the compressor housing, as by welding. An example may be seen in co-assigned U.S. Pat. No. 5,308,231. This design also theoretically avoids bolt holes through the rear head, since the stationary scroll is a permanent part of it. However, the casting process can be quite complex, especially if it is desired to place any pressure wave attenuation structures, such as baffles or sub-chambers.

SUMMARY OF THE INVENTION

The invention provides a method for installing a stationary scroll inside a cylindrical compressor housing that uses no separate fasteners or pins, and which seals the exhaust chamber space between the scroll end plate and compressor rear head. In addition, the exhaust chamber seal cooperates in the installation process. The installation technique also allows a particular baffle structure to be incorporated between the stationary scroll and the rear head.

In the embodiment disclosed, the compressor has a cylindrical housing with an integral rear head closing one end. The housing is cast and machined with an annular, axially outwardly facing shelf that is axially spaced from the inner surface of the rear head. Three evenly angularly spaced locking ramps, each a short annular segment, overlay the shelf. The rear head also has a series of concentric, cylindrical baffle walls, extending axially upwardly from its inner surface, which are axially shorter than the shelf. The rear head is pierced only by a high pressure outlet near its radial outer edge.

The stationary scroll has a disk-shaped end plate with a cylindrical outer edge and a lower surface that faces the rear head. The outer edge of the scroll end plate is notched to produce three evenly spaced locking ramps engageable with the respective locking ramps on the housing, so as to force the scroll end plate tight against the shelf. A circular, resilient seal is notched into the lower surface of the scroll end plate, in the area of radial overlap with the shelf. The lower surface of the scroll end plate also has a series of concentric, cylindrical baffle walls, which extend axially downwardly, with a height comparable to the rear head baffle walls, but at differing radii. The end plate is pierced only by a high pressure inlet at its center.

The stationary scroll is installed by inserting the end plate axially down into the housing, with the respective locking ramps misaligned, until the seal hits and is compressed by the shelf. Then, the scroll is twisted until the ramps wedge past one another, drawing the end plate lower surface and seal tight against the housing shelf. The scroll is thereby held stationary relative to the housing, and a sealed exhaust chamber is formed between it and the rear head. As the scroll end plate is pushed axially into the housing, the respective cylindrical baffle walls axially overlap one another, but they do not interfere as the scroll is twisted into place. Therefore, the high pressure refrigerant that enters the sealed exhaust chamber must pass radially outwardly over and around a series of pressure wave attenuating baffles before it reaches the outlet.

DESCRIPTION OF THE PREFERRED EMBODIMENT

These and other features of the invention will appear from the following written description, and from the drawings, in which.

Figure 1:
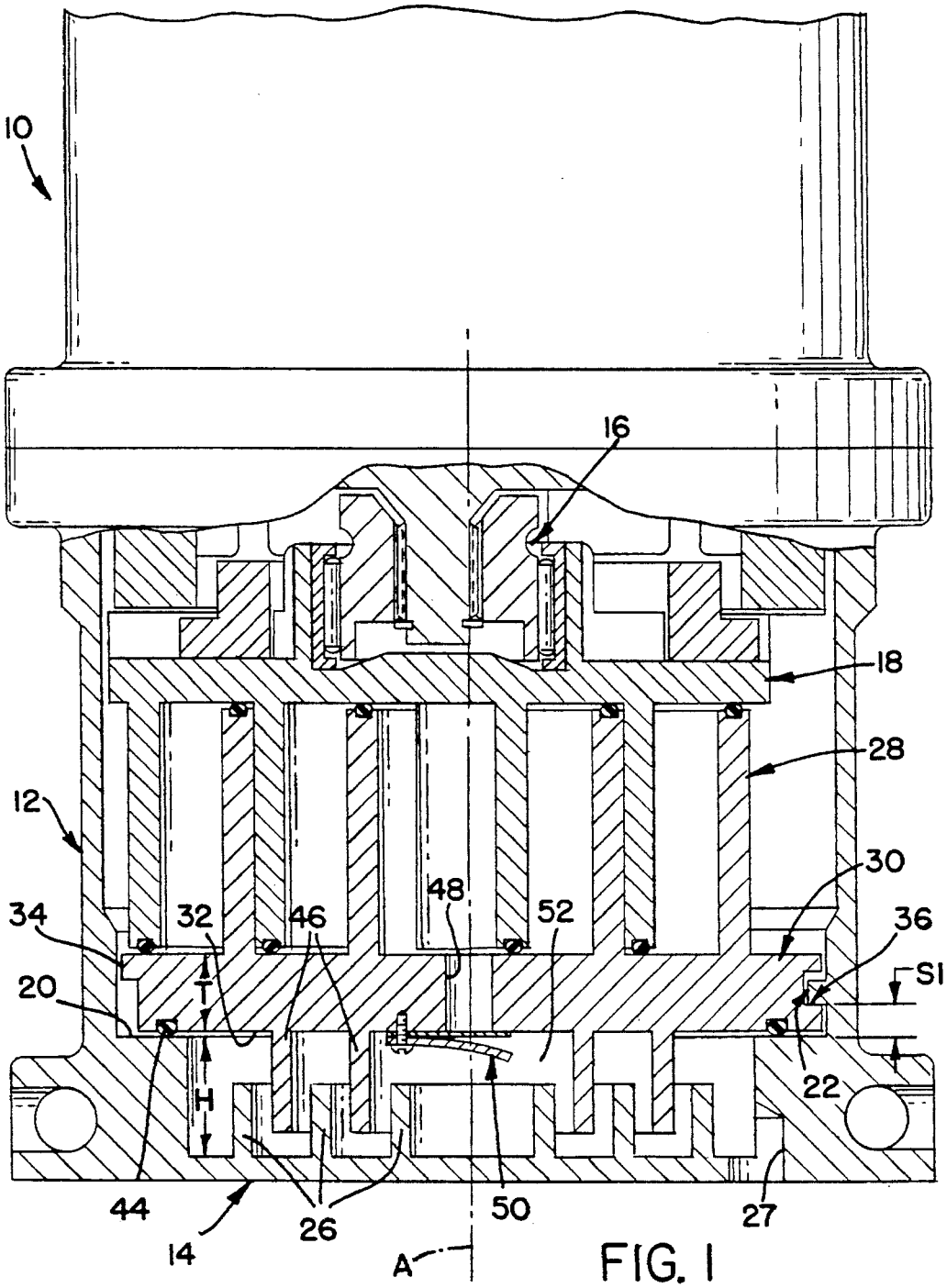
FIG. 1 is a side view of a compressor according to the invention broken away and cross sectioned at the bottom to show the rear head and the scrolls in cross section.
Figure 2:
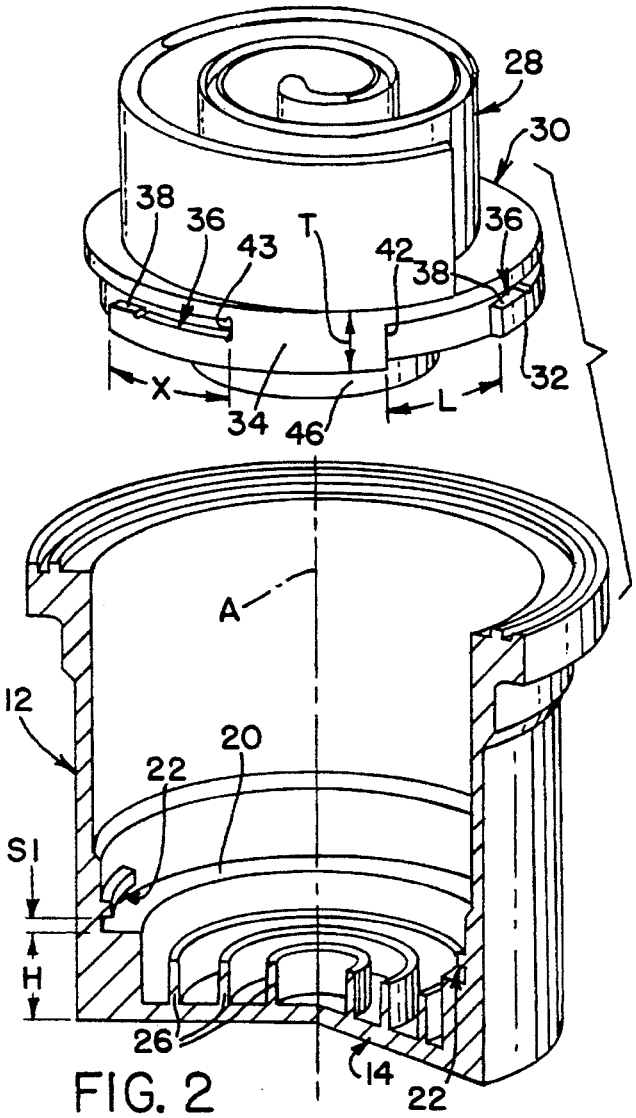
FIG. 2 is a perspective view of a stationary scroll and of a housing cut partially away to reveal inner structure.
Figure 3:
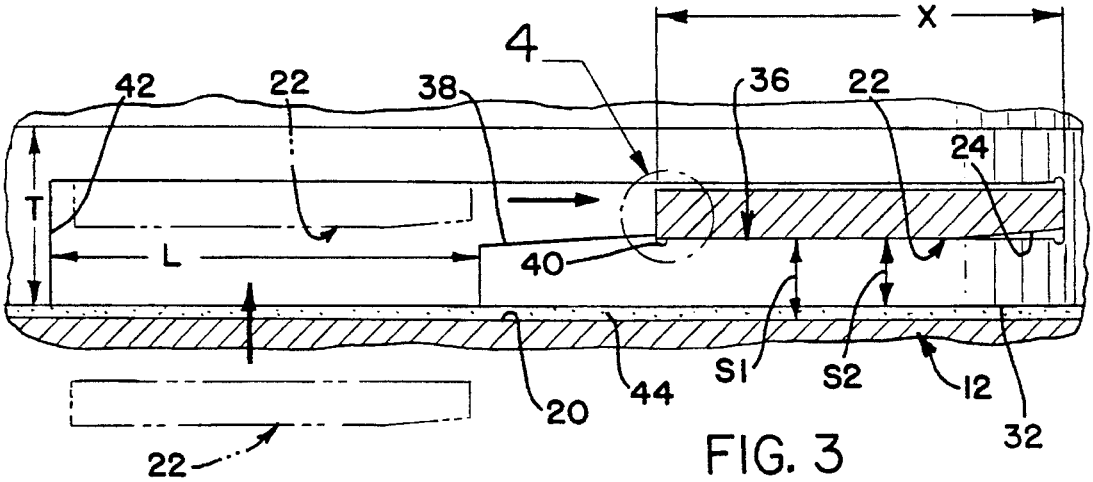
FIG. 3 is an enlarged view of a portion of the outer edge of the stationary scroll outer edge showing one of its locking ramps and indicating the relative path followed by a housing locking ramp when the scroll is installed.

Referring first to FIGS. 1 through 3, a compressor assembled according to the method of the invention, indicated generally at 10, has a cylindrical scroll housing 12 closed at the lower end by an integral rear head 14. The housing 12-rear head 14 unit is integrally cast and machined from a suitable aluminum alloy, with a common central axis indicated by the dotted line at A. Axis A provides the basic reference frame for compressor 10, and most of its components and structural features are concentric to, or perpendicular to, the common axis A. Some surfaces face outwardly along the axis A, that is, toward the open end of housing 12, and some face inwardly, that is, toward the closed rear head 14. One notable exception is the eccentric drive means 16 that orbits a rotating scroll 18, which is offset from the axis A, but this is conventional and necessary in order to create the orbiting motion of scroll 18. Housing 12 has an annular shelf 20 extending radially inwardly from its inner surface, both concentric to and perpendicular to axis A, facing axially outwardly. Shelf 20 has a predetermined height H, as measured relative to the inner surface of rear head 14. Extending radially inwardly from the inner surface of housing 12, and overlaying the shelf 20, are three evenly angularly spaced locking ramps 22, the operative surfaces of which face axially inwardly. Each locking ramp 22 is a short annular segment, concentric to the central axis A, and is parallel to the shelf 20, but for a circumferentially sloped ramp surface 24 at the front. Each housing locking ramp 22 is spaced axially from the shelf 20 by a predetermined amount indicated at S1, which represents the closest spacing of the sloped surface 24 relative to the shelf 20. At the bottom of housing 12, extending axially upwardly from the inner surface of rear head 14, are three concentric baffle walls 26, each with a height less than H. The only interruption in rear head 14 is a high pressure outlet 27, seen in FIG. 1, to which the high pressure line to the condenser would ultimately be attached. Outlet 27 is located as radially distant from the central axis A as possible, outboard of the outermost baffle wall 26.

Figure 4:
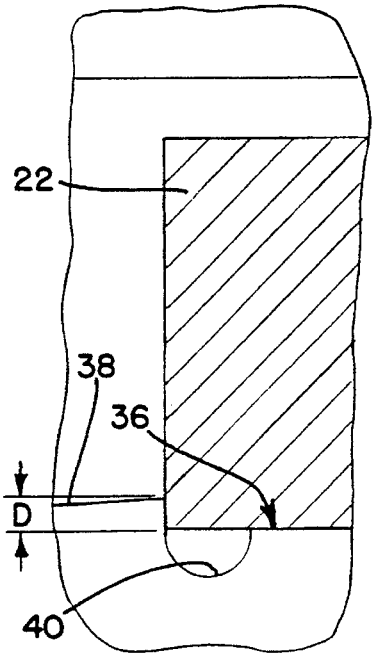
FIG. 4 is an enlargement of the circled and like numbered portion of FIG. 3.

Referring next to FIGS. 2 through 4, a stationary or non-orbiting scroll, indicated generally at 28, has a disk-shaped end plate 30 with an axially inwardly facing lower surface 32 and a cylindrical outer edge 34 of thickness T. The end plate outer edge 34 has a diameter that fits concentrically within housing 12 with a slight radial clearance, assuring that lower surface 32 has a significant annular area of radial overlap with the housing shelf 20, as best seen in FIG. 1. The relatively large thickness of the end plate outer edge 34 allows for three evenly spaced L-shaped notches, which create three locking ramps 36. The operative surfaces of the ramps 36 face axially outwardly, and are radially coextensive with the housing locking ramps 22. Like the housing ramps 22, each end plate locking ramp 36 is flat and perpendicular to the axis A, but for a circumferentially sloped ramp surface 38 at the front of ramp 36 that slopes in the opposite direction to the housing locking ramp sloped surface 24. Apart from the sloped surface 38, the end plate locking ramp is spaced a distance S2 axially from the end plate lower surface 32, which is close to S1 as defined above, but slightly less than S1, to a degree described next. Unlike the housing locking ramp 22, the sloped ramp surface 38 does not merge directly into the rest of the operative surface of locking ramp 36, but instead terminates slightly axially above it, with a differential indicated at D in FIG. 4. S2 is less than S1 to a degree sufficient to accommodate the differential D. A short radius relief cut 40 allows the two surfaces to be separately and accurately machined, leaving a sharp corner between. The front end of each ramp 36 is circumferentially spaced from a vertical shoulder 42 by a distance L that is greater than the equivalent length of a housing locking ramp 22. The terminus of each sloped surface 38 is circumferentially spaced from a shorter vertical shoulder 43 by a distance X that is substantially equal to the length of a housing locking ramp 22. An O ring type seal 44 is notched into the end plate lower surface 32, concentric to and completely surrounding axis A, at a location that overlays the housing shelf 20. Seal 44 stands axially proud of the end plate lower surface 32 to a degree just slightly greater than the differential D, for a purpose described below. Extending axially inwardly from the end plate lower surface 32 are a series of two cylindrical baffle walls 46, which have a height comparable to the housing baffle walls 26, but which are radially staggered relative thereto. End plate 30 is pierced only by a central high pressure inlet 48, which may be covered by a standard reed type discharge valve assembly 50. End plate 30 has no provision for separate threaded fasteners, nor does it need any, as will be described next.

Referring next to FIGS. 2 and 3, the installation of stationary scroll 28 is illustrated. Obviously, the preparatory steps to installation are the manufacture of the housing 12 and scroll 28 with the structural features just described. The structures are fairly simple in shape, and most surfaces and parts could be produced by casting, such as lost foam casting. More critical surfaces would be machined or turned, such as the shelf 20, the end plate lower surface 32, (or at least that portion of it that radially overlaps the shelf 20), and the operative surfaces of the locking ramps 22 and 36. The fact that the surfaces are generally concentric and perpendicular to the co-axis A aids the machining process. Of course, the involute wrap of the scroll 28 would have to be precisely machined in any case. The actual installation of scroll 28 is quite simple. Scroll 28 is pushed axially inwardly into housing 12 until the end plate lower surface 32 makes contact with some part of the housing 12, and then housing 12, or scroll 28, is twisted about the axis A (or, the scroll 28 and housing 12 may be both counter-rotated about the axis A). If it so happens that the housing ramps 22 were already aligned with the circumferential gaps of length L defined above, as shown by the dotted lines in FIG. 3, then the end plate lower surface 32 will move immediately into contact with the shelf 20, cushioned by the seal 44. If not, then the lower surface 32 will hit the top of the housing ramps 22, but continued relative twisting of the scroll 28 will eventually cause the scroll end plate 30 to drop down into the FIG. 3 position. As the end plate 30 drops into position, the respective sets of cylindrical baffle walls 46 and 26 axially overlap, but do not touch each other or any other surface, because of their relative height and radial staggering. So, the twisting motion of installation is not interfered with. Continued turning of scroll 28 in the proper direction relative to housing 12 will cause the respective sloped surfaces 38 and 24 to register and engage one another, because of their equal angular spacing and relative axial spacing as defined. Should the installer turn scroll 28 in the wrong relative direction, the back ends of the housing locking ramps 22 will very quickly hit the shoulders 42. In the latter case, there will be an audible clunk, and further relative twisting will be impossible, clearly signaling the error. In the former case, the installer will sense that the twisting motion has become progressively more difficult, although clearly not blocked. The respective sloped surfaces 38 and 24 will slide and wedge past one another, and, given the inter relationship between S1, S2 and D outlined above, this will cause the end plate 30 to be pulled axially inwardly toward the shelf 20 as the seal 44 is axially compressed. The operator may ease the twisting process, once the correct direction of relative rotation has been determined, by deliberately pushing the scroll 28 down to actively compress the seal 44, thereby allowing the sloped ramp surfaces 24 and 38 to slide past one another more freely. Eventually, the housing locking ramps 22 will shift entirely under and past the scroll locking ramps' sloped surfaces 38, as shown in solid lines in FIG. 3. Given the differential D, the seal 44 will be able to expand slightly, shifting the end plate 30 slightly axially away from the shelf 20 like a spring, and forcing the locking ramps 22 and 36 tightly together with an audible click which signals that installation is complete. Any attempt at further twisting would be resisted by contact between the front ends of the housing locking ramps 22 with the shorter vertical shoulders 43, so the ramps 22 are effectively completely captured in their installed position. The seal 44 remains under some residual compression. The corner of the housing locking ramp 22 will be latched behind the corner of the sloped surface 38, as best seen in FIG. 4. In addition, the scroll 28 could be easily removed by pushing the end plate 30 down to compress the seal 44 and twisting the scroll 28 in the other direction.

Referring next to FIG. 1, the final result of the installation process described is illustrated. The stationary scroll end plate 30 is thoroughly sealed against the shelf 20 to create an exhaust chamber 52 with the rear head 14. The shelf 20 and end plate bottom surface 32 do not directly touch, but are still tightly axially engaged, through the intervening compressed seal 44. There are no separate fastener holes through rear head 14 or housing 12 to create potential leak paths. The refrigerant that is compressed between the relatively orbiting scrolls 18 and 28 is forced through the central inlet 48 in end plate 30 and into the sealed exhaust chamber 52. From there, pressurized refrigerant must move radially outwardly through the chamber 52 around and through the tortuous path created by the radially staggered, axially overlapping baffle walls 26 and 46, before reaching the high pressure outlet 27. Any pressure pulsations are muffled and dampened. The technique lends itself uniquely to the creation of this tortuous path, since the baffle walls 26 and 46 move into relative position in a fashion that is transparent to, and does not interfere with, the task of the installer. In conclusion, the provision of the ramps 22 and 36 and the seal 44 is worth the manufacturing cost given the ease of installing scroll 28 and the more securely sealed, muffled exhaust chamber 52 that results.

Variations in the embodiment disclosed could be made. As disclosed, the ramps 22 are completely captured in the installed position, so that scroll 28 cannot turn in either direction, and therefore has a fixed installed angular position within housing 12. However, simply twisting and jamming the housing and end plate locking ramps 22 and 36 together until the scroll end plate lower surface 32 was tightly pressed against the shelf 20 would keep the stationary scroll from turning, and the other scroll 18 could be aligned relative to it later for proper pumping action, later. So, a set angular installed position for scroll 28 within housing 12 may not be critical, and a simpler design for the scroll end plate ramp 36, one without the shoulder 43 and the discontinuity D at the terminus of sloped surface 38, could work. The seal 44 could be notched into either the end plate lower surface 32 or the shelf 20, so long as it corresponded to their area of radial overlap. Seal 44 could also be radially engaged between the end plate outer edge 34 and the cylindrical inner surface of the housing 12, although that would eliminate the seal's other function of providing an axial spring to help latch the scroll 28 in place. The seal 44 could in fact potentially be eliminated as a separate piece, and S1 made exactly equal to S2, with no seal accommodating differential Do If the shelf 20 and end plate lower surface 32 were machined flat enough, just forcing them tightly together with the wedged locking ramps could provide a seal, as well as preventing the scroll 28 from turning. However, it does not add a great deal of cost to provide the seal 44 in the location shown, nor to machine the differential D into the locking ramp 36, which together create both a very strong seal for exhaust chamber 52 and the resilient latching effect. Fewer than three sets of interengageable locking ramps could be provided, although at least two diametrically opposed sets would be preferable so as to give an even, solid installation. The baffle walls 26 and 46 are not necessary to the basic installation technique, but dove tail nicely with it, requiring no more installation steps and very little extra manufacturing cost. Therefore, it will be understood that is not intended to limit the invention to just the embodiment disclosed.

The embodiments of the invention in which an exclusive property or privilege is claimed are defined as follows:

1. In a scroll compressor having a generally cylindrical housing and a stationary scroll with a disk shaped end plate having an axially inwardly facing lower surface and an outer edge surrounded by said housing, a method for installing said scroll to said housing, comprising the steps of, providing said housing with a generally annular, axially outwardly facing annular shelf having an area of radial overlap with said scroll end plate lower surface, providing said housing with a locking ramp having a circumferentially sloping ramp surface facing in one axial direction, radially overlapped with said shelf, and having a predetermined least axial separation from said shelf, providing said scroll end plate outer edge with a locking ramp with an oppositely circumferentially sloping ramp surface facing in the opposite axial direction from said housing locking ramp surface and radially coextensive therewith, said end plate locking ramp surface having a least axial separation from said end plate lower surface substantially equal to said predetermined least axial separation, inserting said scroll end plate outer edge axially inside of said housing at an angular position in which said respective ramps are angularly misaligned, and, turning said housing and scroll relative to one another until said respective ramp surfaces align with one another, thereby wedging said respective ramp surfaces past one another and forcing said scroll end plate lower surface and housing shelf into tight axial engagement.

2. In a scroll compressor having a generally cylindrical housing with a rear head and a stationary scroll with a disk shaped end plate having an axially inwardly facing lower surface axially opposed to said rear head and an outer edge surrounded by said housing, a method for installing said scroll to said housing, comprising the steps of, providing said housing with a generally annular, axially outwardly facing annular shelf axially spaced from said rear head and having an area of radial overlap with said scroll end plate lower surface, providing one of said shelf and end plate lower surface with a circumferentially complete, axially compressible resilient seal standing proud of said shelf and end plate lower surface, providing said housing with a locking ramp having a circumferentially sloping ramp surface facing in one axial direction, radially overlapped with said shelf, and having a predetermined least axial separation from said shelf, providing said scroll end plate outer edge with a locking ramp having an oppositely circumferentially sloping ramp surface facing in the opposite axial direction from said housing locking ramp surface and radially coextensive therewith, said end plate locking ramp surface having an axial separation from said end plate lower surface that is substantially equal to said predetermined axial separation, inserting said scroll end plate outer edge axially inside of said housing at an angular position in which said respective ramps are angularly misaligned, and, turning said housing and scroll relative to one another until said respective ramp surfaces align with one another, thereby wedging said respective ramp surfaces past one another and forcing said scroll end plate lower surface and housing shelf into tight axial engagement while simultaneously compressing said seal to create a sealed space between said rear head and scroll end plate lower surface.

3. In a scroll compressor having a generally cylindrical housing with a rear head and a stationary scroll with a disk shaped end plate having an axially inwardly facing lower surface axially opposed to said rear head and an outer edge surrounded by said housing, a method for installing said scroll to said housing, comprising the steps of, providing said housing with a generally annular, axially outwardly facing annular shelf axially spaced from said rear head and having an area of radial overlap with said scroll end plate lower surface, providing said housing rear head with a series of axially outwardly extending, concentric cylindrical baffle walls having an axial height less than said shelf to rear head spacing, providing said end plate lower surface with a series of axially inwardly extending, concentric cylindrical baffle walls radially staggered relative to said rear head baffle walls and having an axial height less than said shelf to rear head spacing, providing one of said shelf and end plate lower surface with a circumferentially complete, axially compressible resilient seal standing proud of said shelf and end plate lower surface, providing said housing with a plurality of equally angularly spaced, locking ramps, each having a circumferentially sloping ramp surface facing in one axial direction, radially overlapped with said shelf, and having a predetermined least axial separation from said shelf, providing said scroll end plate outer edge with an equal number of equally angularly spaced locking ramps, each having an oppositely circumferentially sloping ramp surface facing in the opposite axial direction from said housing locking ramp surface and radially coextensive therewith, said end plate locking ramp surfaces having an axial separation from said end plate lower surface that is substantially equal to said predetermined axial separation, inserting said scroll end plate outer edge axially inside of said housing at an angular position in which said respective ramps are angularly misaligned, thereby moving said respective scroll and rear head baffle walls into axially overlapping, radially spaced relation, and, turning said housing and scroll relative to one another until said respective ramp surfaces align with one another, thereby wedging said respective ramp surfaces past one another and forcing said scroll end plate lower surface and housing shelf into tight axial engagement while simultaneously compressing said seal to create a sealed space between said rear head and scroll end plate lower surface within which said axially overlapping baffle walls provide a tortuous path for the exit of compressed refrigerant.

* * * * *

UNITED STATES PATENT AND TRADEMARK OFFICE

CERTIFICATE OF CORRECTION

PATENT NO. : 5,557,845

DATED : September 24, 1996

INVENTOR(S) : Michael J. Burkett; Nikolaos A. Adonakis

It is certified that error appears in the above-identified patent and that said Letters Patent is hereby corrected as shown below:

Column 1, line 7, insert the following paragraph:

--This invention was made with Government support under Subcontract No. NREL-ZCB-3-13032.01 awarded by the U.S. Department of Energy. The Government has certain rights in the invention.--

Signed and Sealed this

Twenty-ninth Day of April, 1997

*Attest:*

*Attesting Officer*

Bruce Lehman

BRUCE LEHMAN

*Commissioner of Patents and Trademarks*